United States Patent [19]

Sokolowski

[11] Patent Number: 4,501,317

[45] Date of Patent: Feb. 26, 1985

[54] CASTING SYSTEM HAVING LUBRICATED CASTING NOZZLES

[75] Inventor: Robert S. Sokolowski, Madison, Conn.

[73] Assignee: Olin Corporation, New Haven, Conn.

[21] Appl. No.: 438,674

[22] Filed: Nov. 3, 1982

[51] Int. Cl.[3] ..... B22D 11/00

[52] U.S. Cl. ..... 164/472; 164/268

[58] Field of Search ..... 164/268, 440, 472, 490; 165/154; 184/6.22

[56] References Cited

U.S. PATENT DOCUMENTS

| | | | |
|---|---|---|---|
| 1,983,466 | 12/1934 | Kline | 165/154 |
| 3,040,396 | 6/1962 | Hudson | 164/472 |
| 3,286,309 | 11/1966 | Brondyke et al. | 164/472 X |
| 3,329,200 | 7/1967 | Craig | 164/440 |
| 3,451,465 | 6/1969 | Moritz | 164/472 X |
| 3,556,197 | 1/1971 | Foye | 164/268 |
| 3,587,718 | 6/1971 | Hopkins | 164/440 |
| 3,612,149 | 10/1971 | Rossi | 164/472 |
| 3,630,266 | 12/1971 | Watts | 164/472 X |
| 4,103,732 | 8/1978 | Habert | 164/472 X |
| 4,157,728 | 6/1979 | Mitamura et al. | 164/472 X |
| 4,214,624 | 7/1980 | Foye et al. | 164/440 X |

*Primary Examiner*—Kuang Y. Lin
*Assistant Examiner*—Richard K. Seidel
*Attorney, Agent, or Firm*—Barry L. Kelmachter; Howard M. Cohn; Paul Weinstein

[57] ABSTRACT

A process and apparatus for continuously casting molten metal is described. To substantially reduce the risk of tearing the forming metal shell and adversely affecting the casting process and ingot quality, lubricant is supplied to the casting mold and at least that portion of the molten metal supply system where freeze-back is most likely to occur. In a preferred embodiment, a system for delivering cooled lubricant is embedded within the material forming the outlet portion of the molten metal supply system.

11 Claims, 5 Drawing Figures

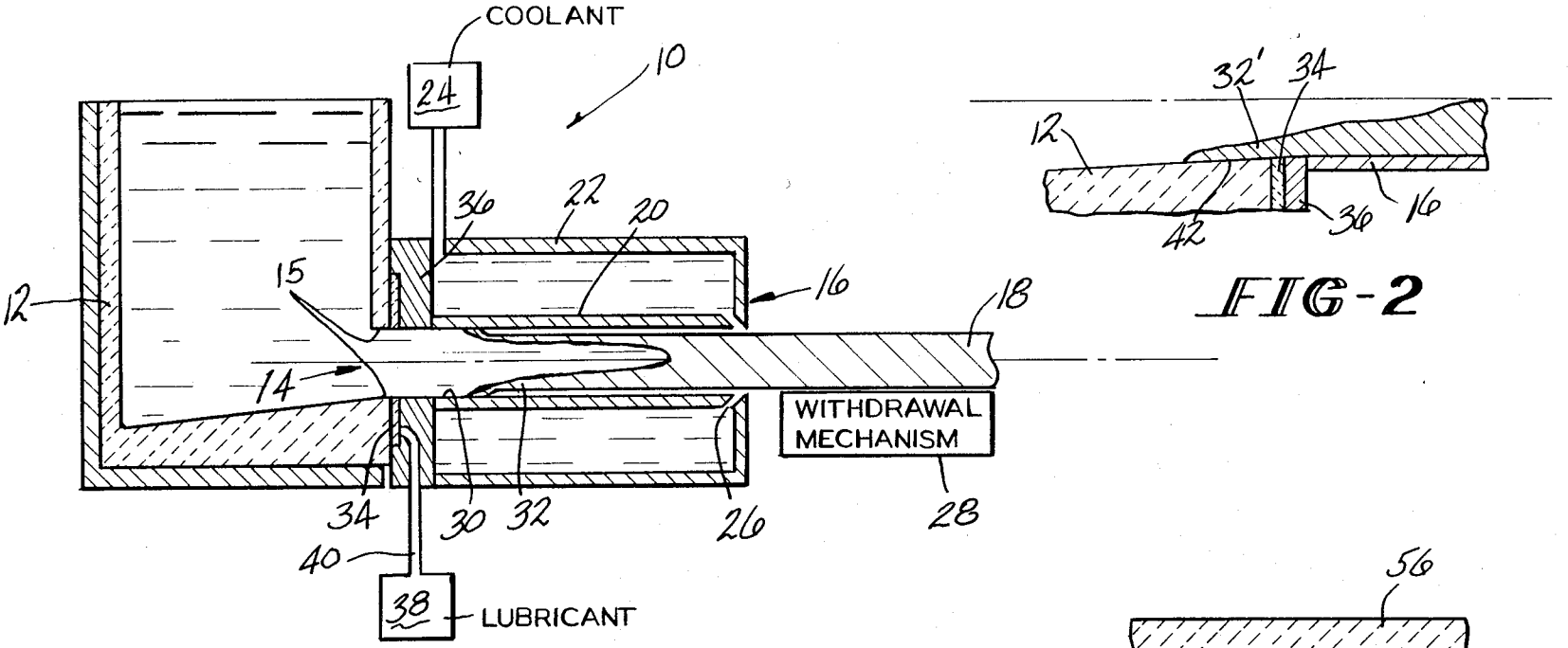
FIG-1
(PRIOR ART)
FIG-2
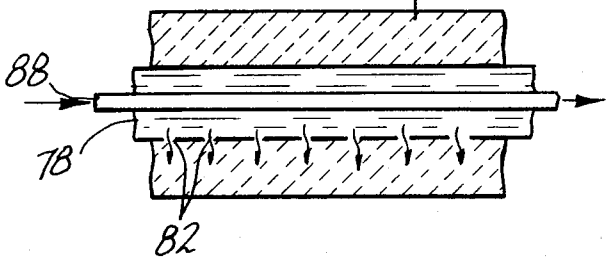
FIG-4

CASTING SYSTEM HAVING LUBRICATED CASTING NOZZLES

This invention relates to an apparatus and method for the continuous casting of molten metal employing a lubricated feed nozzle.

In conventional continuous metal casting practice, a reservoir of molten metal such as a tundish is provided. The molten metal is supplied from the reservoir into a jacketed mold which is generally water-cooled. Typically, the molten metal flows from the reservoir into the mold through a feed nozzle formed by a thermally insulating material. Solidification of the molten metal is initiated and generally effected within the mold by extracting heat from the molten metal as it passes through the mold. The solidified casting or ingot is continuously withdrawn at the discharge end of the mold. In order to assist with continuous casting withdrawal, a suitable withdrawal mechanism is provided adjacent the mold discharge end. If desired, water or some other appropriate coolant may be sprayed onto the casting as it emerges from the mold to effect additional cooling.

One of the major problems encountered in continuous casting is premature freezing of the molten metal, particularly adjacent the mold inlet area. Since the mold is the major source of heat extraction, the necessary contact between the mold and the metal feed system outlet, e.g. a feed nozzle, means an unavoidable cooling of the latter. While, in theory, the feed system shduld be thermally isolated from its environment, in reality it is not. As a result, a skull or shell of metal may form near the mold inlet and extend back or freeze-back into the feed system outlet. This skull of metal can disrupt the mechanics of the solidification process by altering molten metal flow to the mold. In addition, local sticking of the metal shell could occur. As a consequence of these events, surface quality of the casting may be adversely affected and termination of a casting run may occur prematurely.

Surface defects may make a casting unacceptable. One source of such surface defects is local sticking of the metal shell to the inner mold wall followed by tearing of the relatively fragile shell. To prevent adhesion of the metal to the mold wall, it is known to supply a lubricant around the inner mold surfaces. The lubricant spreads over the mold surfaces and prevents metal-to-metal contact.

Frequently, the lubricant is supplied from a source of lubricant, such as an annular channel surrounding the mold, directly to the mold interior via one or more passageways adjacent the molten metal inlet portion of the mold. U.S. Pat. Nos. 3,286,309 to Brondyke et al., 3,329,200 to Craig, 4,103,732 to Habert and 4,157,728 to Mitamura et al. illustrate this type of lubricant supply system. In some lubrication systems, the passageway or passageways lie between the mold inlet portion and a feed nozzle outlet portion. U.S. Pat. Nos. 3,040,396 to Hudson and 3,630,266 to Watts exemplify this latter type of system.

To provide better control over the rate of flow of lubricant into the mold, it has been suggested in the prior art to incorporate a porous body, such as a gasket or a wick, into the lubricant feed system. The porosity of the body incorporated in the feed system determines the rate of lubricant flow. U.S. Pat. Nos. 4,214,624 to Foye et al. and 3,451,465 to Moritz illustrate lubricant feed systems incorporating a porous body.

While these prior art lubrication systems assist in preventing adhesion of the metal shell to the mold wall, they do not significantly prevent premature metal freezing and freeze-back into the outlet of the molten metal supply or feed system. This freeze-back problem can be particularly troublesome during the casting of relatively thin members such as strip material.

The thin metal shell formed as a result of freeze-back within the outlet portion of the feed system has relatively little strength and shell tearing occurs easily. Tearing of the shell may cause disruptions in lubricant flow and/or the normal supply of molten metal to the mold. As previously discussed, these disruptions may cause the production of surface defects in the cast product and the termination of casting.

It has been suggested in the prior art that the freeze-back problem may be avoided by applying heat adjacent the feed nozzle/mold interface. In one such system, the feed nozzle is surrounded by heating coils. Heat supplied to the metal within the feed nozzle prevents any solidification of the molten metal. U.S. Pat. No. 3,587,718 to Hopkins exemplifies this type of system.

In a similar system, a duct is attached to the inlet end of the mold. Molten metal is fed to the mold through a feed spout or nozzle extending into the duct. Heat is applied to the metal in the duct by an electrical induction coil surrounding the duct. Any metal solidified on the end of the feed spout is melted and the metal within the duct retains molten. A lubricating material is applied to the periphery of the metal at the mold entrance via pipes extending through the duct. This type of system is shown in U.S. Pat. No. 3,612,149 to Rossi.

While these systems do perform effectively, they tend to be complicated and cumbersome. Frequently, the feed duct or nozzle needs to be formed from special materials and/or needs to be preheated for relatively long periods of time prior to the initiation of a casting run. In addition, the casting run may have to be terminated if the heating system fails.

The instant invention provides an apparatus and a process for effectively controlling the continuous casting operation so as to avoid disruptions in molten metal flow to the casting mold and to prevent local sticking of any metal shell. The apparatus includes a feed nozzle for supplying molten metal to the mold. The feed nozzle is formed from a porous material and has embedded within itself a system for supplying lubricant to the inner surface of the feed nozzle and the mold. By supplying lubricant to the inner surface of the feed nozzle, any metal shell formed within the feed nozzle is prevented from adhering to the feed nozzle surface. In this manner, tearing of the metal shell and the aforementioned casting and surface defect problems may be avoided.

In a preferred embodiment of the instant invention, cooled lubricant is supplied to the feed nozzle inner surface. If the lubricant were not cooled, it could decompose prior to reaching the feed nozzle surface. To insure a continuous supply of cooled lubricant, the lubricant supply system preferably comprises a lubricant passageway having an inner passageway through which a coolant such as water flows.

In addition to the coolant passageway, the lubricant passageway is provided with a plurality of openings through which the lubricant flows into the feed nozzle material. The lubricant flows through the porous feed nozzle material to the feed nozzle inner surface. If a gasket means such as a porous wick is located between the feed nozzle and the mold, lubricant will also flow through the material to the gasket means. By providing lubricant to the gasket means as well as the feed nozzle inner surface, a continuous supply of lubricant to the mold may be assured. The lubricant passageway openings preferably are arranged so that lubricant is applied to the region where freeze-back is most likely to occur. In a preferred embodiment, the openings are directed at the mold/feed nozzle interface.

Accordingly, it is an object of the instant invention to provide a simpler and more efficient continuous casting process and apparatus that has particular utility in the casting of relatively thin members.

It is a further object of this invention to provide a process and apparatus as above for substantially eliminating frictional problems associated with freeze-back and formation of thin-shelled structures.

It is a further object of this invention to provide a process and apparatus as above for providing a continuous supply of lubricant to the outlet portion of the molten metal feed system and/or the casting mold for substantially preventing fracture of solidified metal shell.

These and other objects will become more apparent from the following description and drawings.

Embodiments of the method and apparatus for continuously casting molten metal are shown in the drawings wherein like numerals depict like parts.

FIG. 1 is a schematic representation in partial cross section of a side view of a prior art casting apparatus.

FIG. 2 is an illustration of freeze-back of a metal shell into a molten metal feed system.

FIG. 4 is a schematic representation of a preferred embodiment of the lubricant supply system of FIG. 3.

Figure 3:
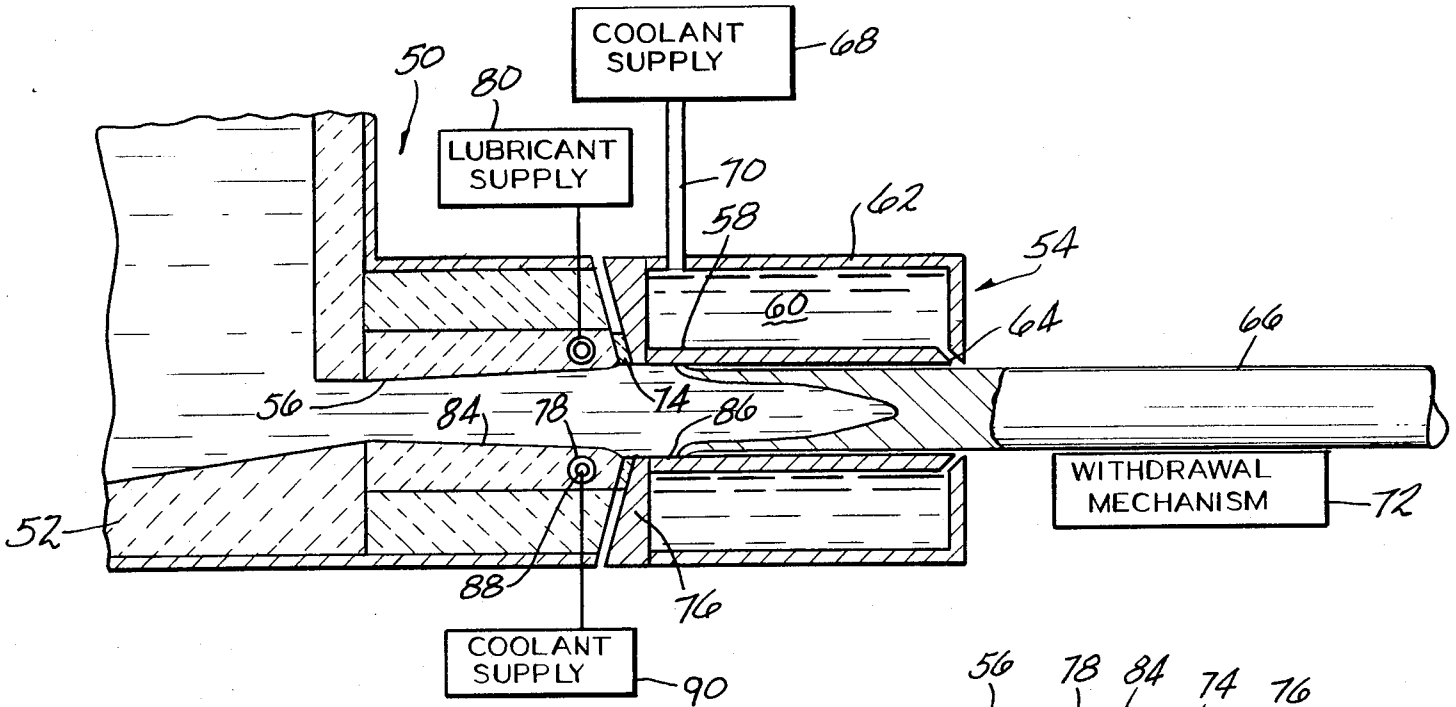
FIG. 3 is a schematic representation in partial cross section of the casting apparatus of the instant invention.

Referring now to the drawings, FIG. 1 illustrates a prior art system 10 for continuously casting molten metal. Molten metal is supplied from a source such as a furnace not shown to a reservoir such as tundish 12. The molten metal is fed through outlet opening 14 in tundish 12 into the inlet portion of direct-chill, hereinafter DC, casting mold 16. Casting mold 16 comprises an open ended body having a cross-sectional shape corresponding to the cross-sectional shape of the ingot 18 to be cast.

Surrounding the mold is a manifold 22 containing a suitable coolant such as water. Manifold 22 communicates with a supply 24 of coolant via any suitable means. Solidification of the molten metal is effected by extracting heat from the molten metal as it passes through the mold 16.

Ingot 18 is withdrawn from the mold 16 by a suitable withdrawal mechanism 28 such as a V-belt or a roller arrangement. If desired, additional coolant may be sprayed onto the emerging ingot 18 through nozzles 26.

To prevent adhesion of the forming metal shell 32 to the inner mold wall 30, lubricant is continuously supplied to the mold interior. Typically, the lubricant is supplied adjacent the inlet portion 36 of the mold. One known manner of supplying lubricant is illustrated in FIG. 1. An annular slotted gasket 34 is provided between the inlet portion 36 and the tundish 12. Lubricant is provided from a supply 38 to the slotted gasket 34 via a passageway 40. The lubricant flows through the slotted gasket and onto the interior mold surface.

Disruptions in the flow of molten metal to the mold and the problem of local sticking may occur as a result of freeze-back of the metal shell into the outlet portion of the molten metal feed system, e.g. outlet opening 14. This freeze-back problem is illustrated in FIG. 2. As shown therein, metal shell 32' may grow back beyond the mold inlet portion 36 and the gasket 34 for supplying lubricant to the mold. Since lubricant is not being supplied to the molten metal feed system, the thin and relatively weak shell 32' could adhere to the wall 42 of the feed system. Wall 42 may be a portion of the tundish wall adjacent opening 14 or may be a portion of a feed nozzle if one is used. Since the shell 32' is thin and weak, the normal flow of molten metal into the mold may cause any shell sticking to the wall 42 to rupture or tear. This may result in disruption of the molten metal flow and the production of surface defects in the final cast product. As well as adhering to the wall 42, metal shell 32' could block the flow of lubricant from the gasket 34 into the mold interior. The freeze back problem can be particularly acute when casting members such as relatively thin metal strip.

Figure 5:
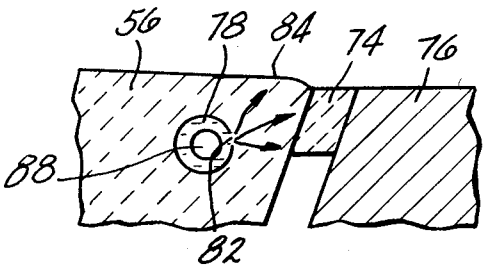
FIG. 5 is an exploded view in partial cross section of the feed nozzle/mold interface of the casting apparatus of FIG. 3.

The instant invention provides a mechanism for preventing adhesion of any metal shell to the walls of the molten metal feed system and substantially avoiding the aforementioned problems. A system for lubricating the molten metal feed system adjacent the mold inlet portion as well as the mold is illustrated in FIGS. 3–5.

The casting apparatus 50 of the instant invention has a tundish 52 which acts as a reservoir of molten metal. Molten metal may be supplied to the tundish 52 from any conventional molten metal source not shown such as a furnace in any well known manner. Molten metal from tundish 52 is fed to a casting mold 54 via a suitable feed system such as feed nozzle 56.

Casting mold 54 may comprise any suitable conventional casting mold known in the art. In a preferred embodiment, mold 54 comprises a DC casting mold. The outer wall 58 of the mold is in communication with a coolant located in a manifold 60 formed by the jacket 62. As before, solidification is effected by extracting heat from the molten metal as it passes through the mold 54. Preferably, nozzles 64 are provided to spray additional coolant onto emerging ingot 66.

Coolant may be supplied to manifold 60 from supply 68 in any suitable manner such as passageway 70. If desired, passageway 70 may be provided with a suitable valve arrangement not shown for controlling the rate of coolant flow into manifold 60.

The emerging ingot is withdrawn from the mold 54 in a conventional manner by withdrawal mechanism 72. Withdrawal mechanism 72 may comprise any suitable conventional withdrawal mechanism known in the art. The rate at which the withdrawal mechanism 72 withdraws the ingot 66 from the mold will in part determine the rate at which molten metal flows into the mold.

For reasons which will be discussed hereinafter, it is preferred that a gasket 74 be disposed between the feed nozzle 56 and the inlet portion 76 of the mold 54. Although any suitable gasket may be used, it is preferred that the gasket 74 comprise a high temperature wick formed from a porous material. Fibrous refractory paper, felt, or any suitable material having sufficient porosity may be used to form the wick or gasket.

Feed nozzle 56 is preferably formed from a refractory material having a sufficiently low thermal conductivity that the extent of any shell formed adjacent the feed nozzle is small and steady state heat losses are minimized. In addition to the aforementioned thermal conductivity property, the feed nozzle material should have sufficient porosity that a fluid, such as a liquid or gaseous lubricant, can be made to flow through it. Any suitable refractory material having the above properties may be used to form feed nozzle 56. One type of material which may be used is exemplified by porous refractory fiber boards such as SALI made by Zircar or GH board made by Carborondum.

In accordance with the instant invention, a system for lubricating the feed nozzle area and the mold is provided adjacent the mold inlet. It has been found that such a system is particularly advantageous in minimizing the frictional problems associated with metal freeze-back into the feed nozzle area and in providing lubricant to the interior of the mold.

In a preferred arrangement, the lubricant system of the instant invention comprises a lubricant passageway or conduit 78 embedded within the feed nozzle 56. Lubricant passageway 78 has a plurality of openings 82. The openings 82 are directed such that lubricant will be applied to the region where freeze-back is most likely to occur. In a preferred embodiment, openings 82 are directed at the mold/feed nozzle interface. Lubricant flows through the openings 82 into the porous refractory feed nozzle material and eventually seeps onto the feed nozzle surface 84 where it lubricates the surface 84. In addition to lubricating surface 84, some lubricant will flow into the mold 54 and onto mold surface 86.

Lubricant may be supplied from a source of lubricant 80 to passageway 78 in any suitable manner and at any desired rate. If desired, lubricant may be fed into passageway 78 through one or more inlets not shown. The openings 82 are sized such that a substantially uniform flow of lubricant occurs along the passageway 78. This is particularly important when lubricant is being supplied through more than one inlet.

As well as flowing through the refractory feed nozzle material to the surface 84, the lubricant flows through the nozzle material to the porous gasket 74. By constructing the gasket 74 from a porous material, lubricant will flow through the gasket to the mold interior. The use of such a porous gasket construction is particularly advantageous in situations where blockage of the lubricant flow through the feed nozzle material onto surface 84 could occur. In such an instance, the gasket acts as an escape valve for the lubricant and insures a continuous supply of lubricant to the inner mold surface 86.

During casting, temperatures in the feed nozzle are sufficiently high that a lubricant could decompose before it reaches the surface 84. To prevent this occurrence, the lubricant supply system of the instant invention provides cooled lubricant to the surface 84. While any suitable arrangement may be used to provide cooled lubricant, it is preferred to centrally locate a coolant passageway 88 within lubricant passageway 78. The passageway 88 preferably has a constant supply of a suitable coolant such as water flowing through it. The coolant may be furnished to and removed from the passageway 88 in any suitable manner. Coolant may be supplied from either a separate coolant supply 90 or the mold coolant supply 68. If desired, a valve not shown may be used to control the flow rate of coolant through the passageway 88.

It has been found that by supplying lubricant to the surface 84 there is substantially no adherence of metal shell formed in the feed nozzle tip or outlet portion to the surface. As a result, shell fracture or tearing is minimized and superior quality castings or ingots may be produced. In addition, pyrolysis of the lubricant at the hot surface 84 produces a surface possessing greater anti-friction properties than the base feed nozzle material with attendant advantages in smooth molten metal flow.

As previously discussed, the lubricant supply system of the instant invention has particular application in continuous casting systems for producing relatively thin members such as strip.

The lubricant may comprise any suitable material and may be applied in any suitable fluid form. In a preferred arrangement, the lubricant comprises rapeseed oil. Alternatively, the lubricant may comprise graphite, high temperature silicone, castor oil, other vegetable and animal oils, esters, paraffins in liquid form, other synthetic liquids or any other suitable lubricant typically used in the casting art.

While a horizontal casting apparatus has been illustrated in the drawings, the instant invention is equally applicable to casting apparatuses having a vertical or any other orientation.

While the lubricant supply system has been described as being embedded within a feed nozzle, it may be used in conjunction with any type of molten metal feed system such as the outlet opening 14 formed by walls 15 in FIG. 1.

As used herein, the term metal includes metal and metal alloy systems.

While a preferred arrangement for the openings 82 has been illustrated in FIGS. 3–5, any suitable arrangement of the openings may be utilized. For example, a plurality of circumferentially and axially spaced openings may be provided.

While the feed nozzle 56 has been described as being formed preferably from a porous refractory material, it may be formed from any suitable porous material. If desired, feed nozzle 56 could be formed from a refractory metal such as tantalum.

The patents set forth in the specification are intended to be incorporated by reference herein.

It is apparent that there has been provided in accordance with this invention a casting system having a lubricated casting nozzle which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An apparatus for casting molten metal, said apparatus comprising:

a mold for effecting solidification of said molten metal into an ingot;

means adjacent to an inlet portion of said mold for feeding said molten metal into said mold, said feeding means being separate from said mold and being formed from a porous material; and means for delivering a cooled lubricant to a surface of said feeding means contacting said molten metal to substantially prevent adhesion of any solidified metal on said surface, said lubricant delivering means comprising a first passageway through which said lubricant flows embedded within said porous material of said feeding means, a second concentric passageway containing a coolant located within said first passageway, and at least one opening in said first passageway for permitting lubricant from said first passageway to flow through said porous material to said molten metal contacting surface.

2. The apparatus of claim 1 further comprising:

said first passageway having a plurality of openings through which said lubricant flows, said openings being directed so that said lubricant is applied to regions of said surface where freeze-back of said metal is most likely to occur.

3. The apparatus of claim 2 further comprising:

said openings being directed towards the interface between said molten metal feed means and said mold.

4. The apparatus of claim 2 further comprising:

additional means for supplying said mold with said lubricant, said additional means being located between said inlet portion of said mold and a portion of said molten metal feed means and being in communication with said openings.

5. The apparatus of claim 4 wherein said additional means comprises a gasket formed from a porous material capable of withstanding relatively high temperatures.

6. The apparatus of claim 2 wherein said molten metal feed means comprises a feed nozzle formed from a refractory material having a relatively low thermal conductivity.

7. A process for casting molten metal, said process comprising:

providing means for supplying molten metal to a mold adjacent an inlet portion of said mold, said supplying means being separate from said mold;

feeding said molten metal into said mold; and at least partially solidifying said molten metal within said mold, wherein the improvement comprises:

forming at least one wall of said molten metal supply means from a porous material; flowing a lubricant through a first passageway embedded in said porous material; flowing a coolant through a second concentric passageway located within said first passageway; and expelling said lubricant from said first passageway so that cooled lubricant flows through said porous material to a surface of said at least one wall contacting said molten metal to substantially prevent adhesion of any solidified metal on said surface and to reduce the likelihood of tearing any solidified metal within said molten metal supply means.

8. The process of claim 7 wherein said expelling step comprises:

providing said first passageway with a plurality of openings through which said lubricant flows into said porous material; and directing said openings so that said lubricant is applied to regions of said surface where freeze-back of said metal is most likely to occur.

9. The process of claim 8 wherein said directing step comprises directing said openings toward the interface of said mold and said molten metal supply means.

10. The process of claim 8 further comprising:

providing additional means for supplying said mold with said lubricant; and flowing said lubricant through said porous material to said additional means, whereby a continuous supply of lubricant to said mold is provided.

11. The process of claim 8 wherein:

said molten metal supply means comprises a feed nozzle formed from a porous refractory material having a relatively low thermal conductivity; and said flowing and expelling steps comprise flowing said cooled lubricant through said porous refractory material to surfaces of said feed nozzle contacting said molten metal.

* * * * *